United States Patent [19]

Chamberlain

[11] 4,018,103

[45] Apr. 19, 1977

[54] CONTROL LINKAGE MECHANISM

[75] Inventor: Richard W. Chamberlain, Aurora, Ill.

[73] Assignee: Caterpillar Tractor Co., Peoria, Ill.

[22] Filed: July 14, 1975

[21] Appl. No.: 595,823

[52] U.S. Cl. ..... 74/519; 74/520

[51] Int. Cl.[2] ..... G05G 1/04

[58] Field of Search ..... 74/519, 516, 518, 520, 74/521, 523

[56] References Cited

UNITED STATES PATENTS

| | | | |
|---|---|---|---|
| 2,369,362 | 2/1945 | Marziani | 74/520 X |
| 2,372,852 | 4/1945 | Randall | 74/520 X |
| 2,882,744 | 4/1959 | Keller | 74/520 X |
| 3,125,897 | 3/1964 | Zeman | 74/519 X |
| 3,142,199 | 7/1964 | Burton et al. | 74/520 UX |
| 3,159,049 | 12/1964 | Lahti | 74/519 |
| 3,429,412 | 2/1969 | Wobrock | 74/512 X |
| 3,466,943 | 9/1969 | De Lacroix | 74/516 |
| 3,495,476 | 2/1970 | Tedrake | 74/516 |

*Primary Examiner*—Edgar W. Geoghegan
*Attorney, Agent, or Firm*—Phillips, Moore, Weissenberger, Lempio & Majestic

[57] ABSTRACT

A linkage mechanism is interposed between a pedal and a movable actuating member, and movement of the pedal in one direction is resisted by the extension of a resilient helical spring. The linkage and spring are arranged so that movement of the pedal in such one direction is resisted by a substantially constant force throughout the travel of such pedal in such one direction.

11 Claims, 5 Drawing Figures

CONTROL LINKAGE MECHANISM

BACKGROUND OF THE INVENTION

This invention relates to a linkage mechanism, and more particularly, to a linkage mechanism which, in combination with a spring, provides for the resisting of movement of an element associated with the linkage mechanism in one direction with a substantially constant force throughout the travel of such element.

In the design of, for example, a conventional governor linkage mechanism, such linkage mechanism is generally arranged so that a pedal associated therewith is depressed to acutate such linkage. The movement of the pedal is resisted by a spring, and as the pedal is further and further depressed, the spring provides a greater and greater resistance to further depression of the pedal. That is, the force required to depress the pedal a given distance at the end of its travel is much greater than the force required to depress the pedal a certain distance at the beginning of its travel. Such increase in force has been found to cause operator fatigue resulting in a less than maximum efficiency of operation of the vehicle with which the governor linkage is associated.

U.S. Pat. No. 3,466,943 and U.S. Pat. No. 3,495,476 disclose variable-ratio lever mechanisms. However, in each of these systems, the variable-ratio lever mechanism produces in an initial portion of a stroke a large output movement with a low output force, and in a final portion of the stroke a high output force.

SUMMARY OF THE INVENTION

Accordingly, an object of this invention is to provide a linkage mechanism which provides that the force necessary to actuate such a mechanism remains substantially constant throughout the actuating travel of the linkage mechanism.

It is a further object of this invention to provide a linkage mechanism which, while fulfilling the above objects, is highly efficient in design and simple in construction.

Broadly stated, the invention comprises a linkage mechanism comprising support means, and a first link pivotally mounted on a first fixed pivot relative to the support means and pivotable in first and second directions. A second link is pivotally mounted on a second fixed pivot relative to the support means and pivotable in first and second directions. Further included is a third link having (i) a first portion pivotably mounted to a portion of the first link spaced from the first fixed pivot, and (ii) a second portion mounted to a portion of the second link spaced from the second fixed pivot. The first, second, and third links are arranged to to provide that pivoting of the first link in the first direction thereof pivots the second link in the first direction thereof through the third link. Resilient means are included for resiliently resisting pivoting of the first and second links in the respective first direction thereof. The first, second, and third links are positioned so that as the first link is pivoted in the first direction thereof to pivot the second link in the first direction thereof through the third link, the third link shifts in position to provide continuously increasing effective lever arm about the second fixed pivot through which force is applied from the third link to pivot the second link in the first direction thereof.

BRIEF DESCRIPTION OF THE DRAWINGS

These and other objects of the invention will become apparent from a study of the following specification and drawings, in which.

DESCRIPTION OF THE PREFERRED EMBODIMENTS

Figure 4:
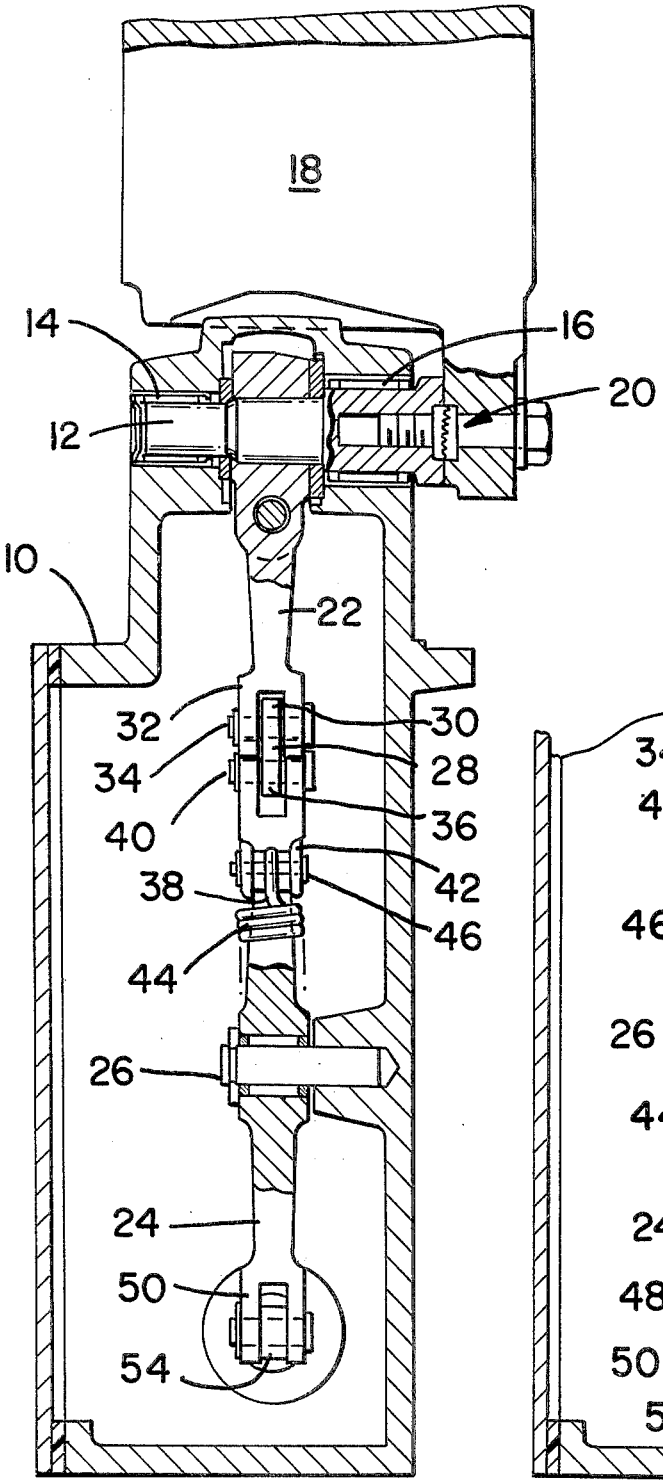
FIG. 4 is an end view, partially in section, of the apparatus, with portions thereof removed.
Figure 5:
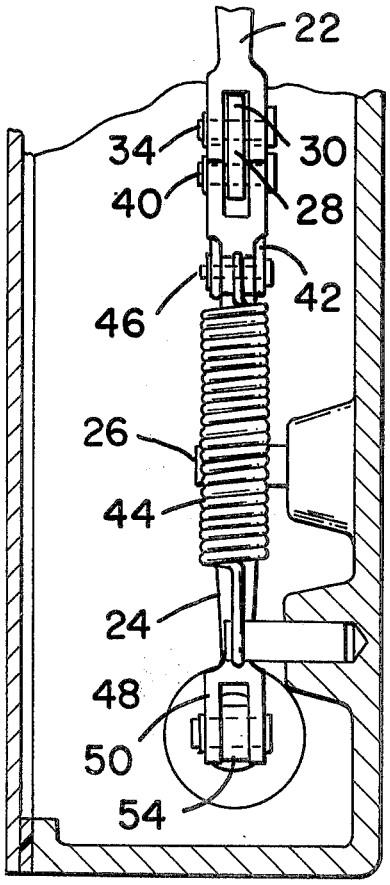
FIG. 5 is a view similar to that shown in FIG. 4, but showing the association of the resilient helical spring with the support means.

As shown in the drawings, a support casing 10 pivotally supports an upper pin 12 disposed transversely thereof. The pivot pin 12 is supported in the casing 10 by bearings 14, 16 and a pedal 18 is fixed to an end of the pivot pin 12 by fastening means 20 best shown in FIG. 4. Fixed to pivot pin 12 adjacent the middle thereof is a link 22. It will be seen that the pivot pin 12 defines a pivot fixed relative to the support casing 10, about which the pedal 18 and link 22, moving with the pin 12, are pivotable in first and second opposite directions, the first direction being the direction of depression of the pedal 18, and the second direction being the direction of the raising of the pedal 18.

A link 24 is pivotally mounted on a pin 26 which is secured to the casing 10, the link 24 being mounted between its ends on such pivot pin 26. Such pin 26 defines a pivot fixed relative to the support casing 10 about which such link 24 is pivotable. Yet another link 28 has an end portion 30 thereof pivotally mounted to the lower end portion 32 of the link 22 by means of a pin 34, and another end portion 36 mounted to the upper end portion 38 of the link 24 by means of a pin 40. The pivot axis defined by the pin 40 and the pivot axis defined by the pin 26 are spaced apart along the link 24, and the pivot axis defined by the pin 32 and the pivot axis defined by the pin 12 also spaced apart along the link 22.

It will also be seen that upon pivoting of the pedal 18 in a pedal-depressing direction, the link 22 pivots in the first direction thereof, to in turn pivot the link 24 in a first direction thereof through the link 28. Conversely, raising of the pedal 18 to its non-depressed state pivots the link 22 in the second direction thereof, which, through the link 28, pivots the link 24 in a second direction thereof.

The upper portion of the link 24 has fixed thereto an extended portion 42, and an elongated, resilient helical spring 44 has one end mounted on such extension 42 by means of a pin 46, and the other end mounted on a pin 48 fixed to the support casing 10. The spring 44 is chosen to be continuously under tension, no matter what the position of the pedal 18, but it is to be, of course, understood that as such spring 44 is extended, greater spring force is applied to the elements which it interconnects to tends to draw them together.

It is to be seen that through the positioning of such spring 44, the spring 44 resists pivoting of the links 22,

24, 28 in the first respective directions thereof through depression of the pedal 18.

Associated with the bottom end 50 of the link 24 is a push-pull cable structure 52, an end 54 of which is pivotally mounted to the end 50 of such link 24, and it will be seen that pivoting of the pedal 18 about the fixed pivot defined by the pin 12 actuates such push-pull cable 52.

Figure 1:
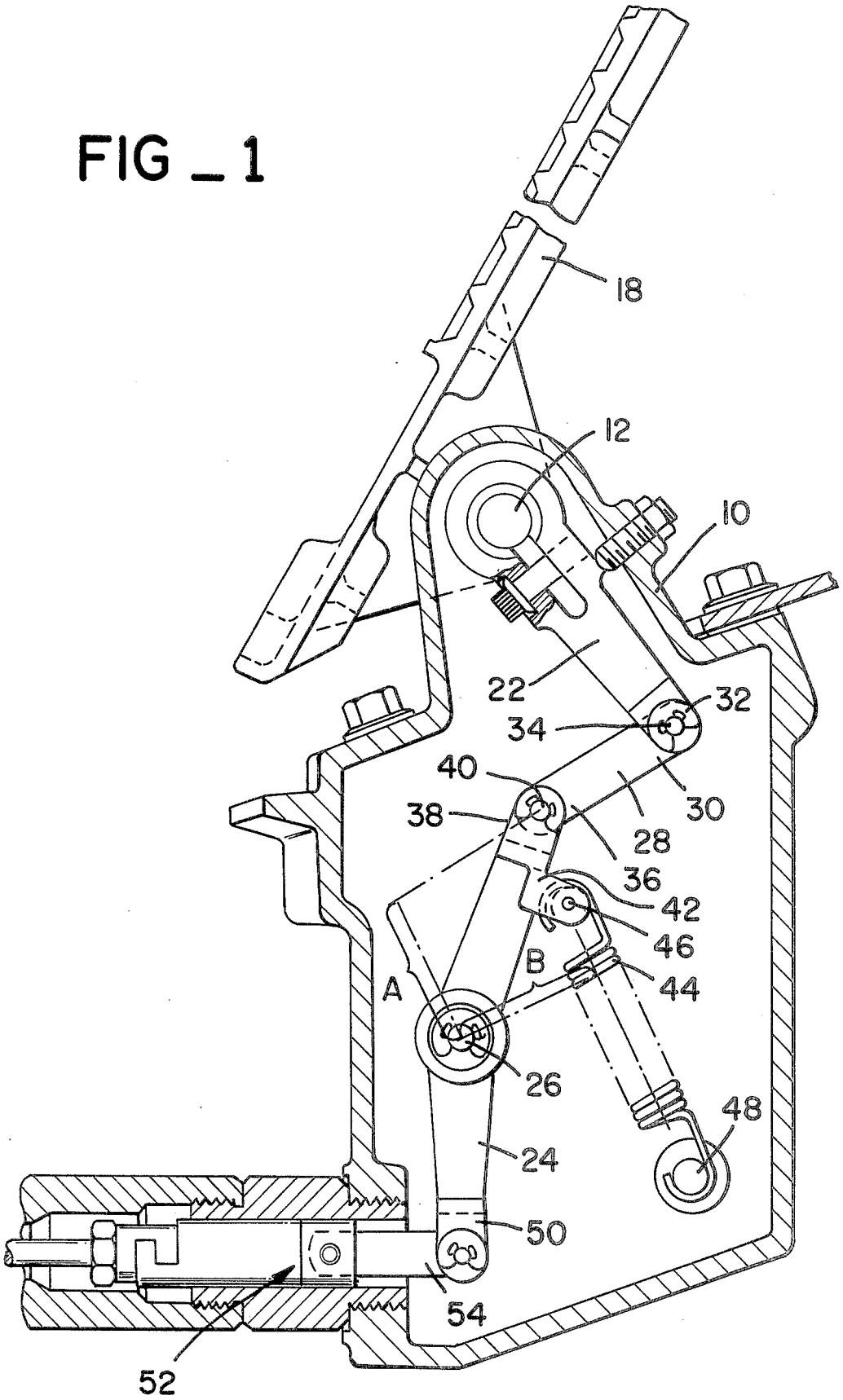
FIG. 1 is a side elevation, partially in section, of the linkage mechanism and associated structure, with the pedal associated therewith in a fully non-depressed state.
Figure 2:
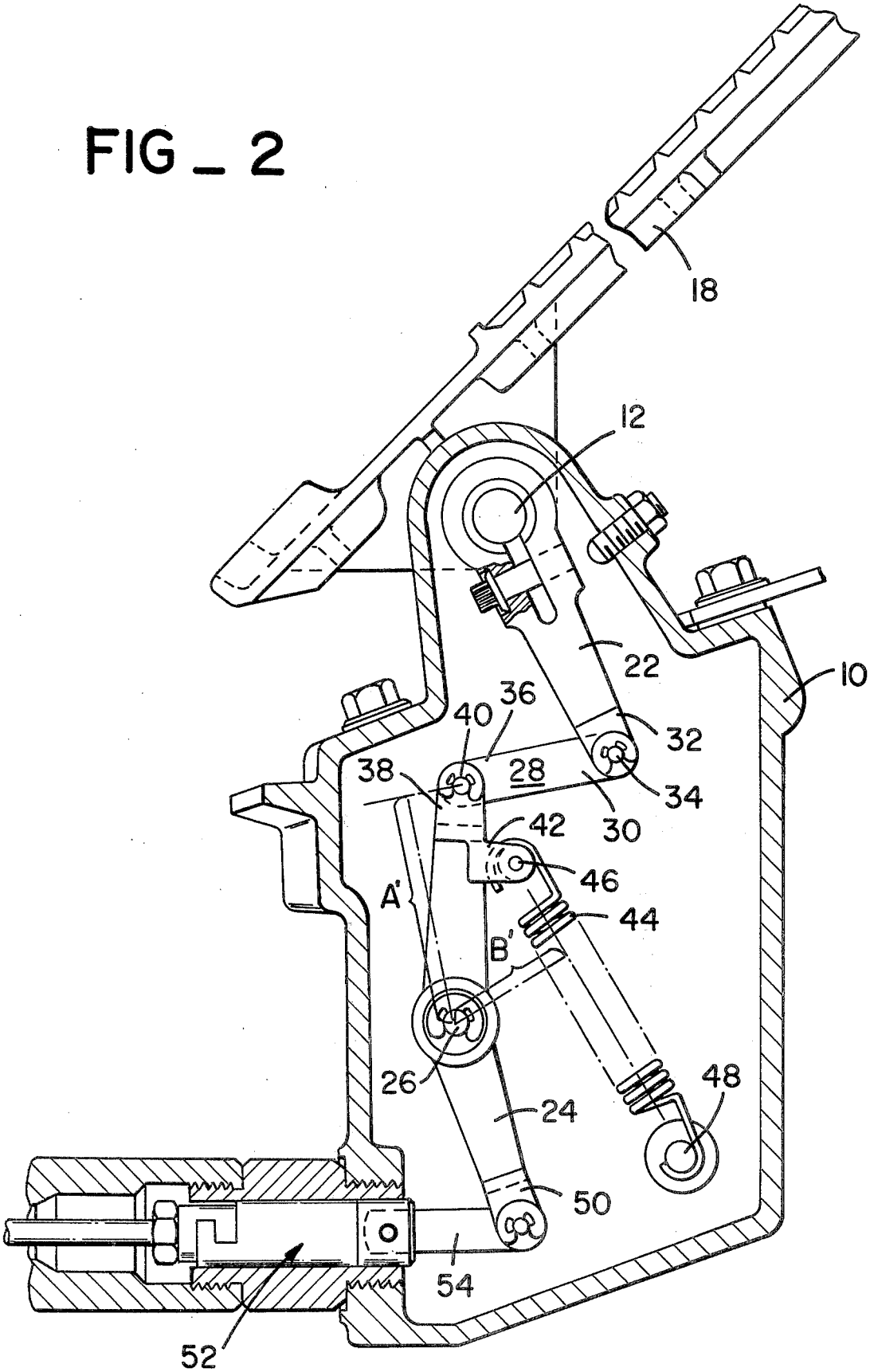
FIG. 2 is a view similar to that shown in FIG. 1, with the pedal depressed to an extent.
Figure 3:
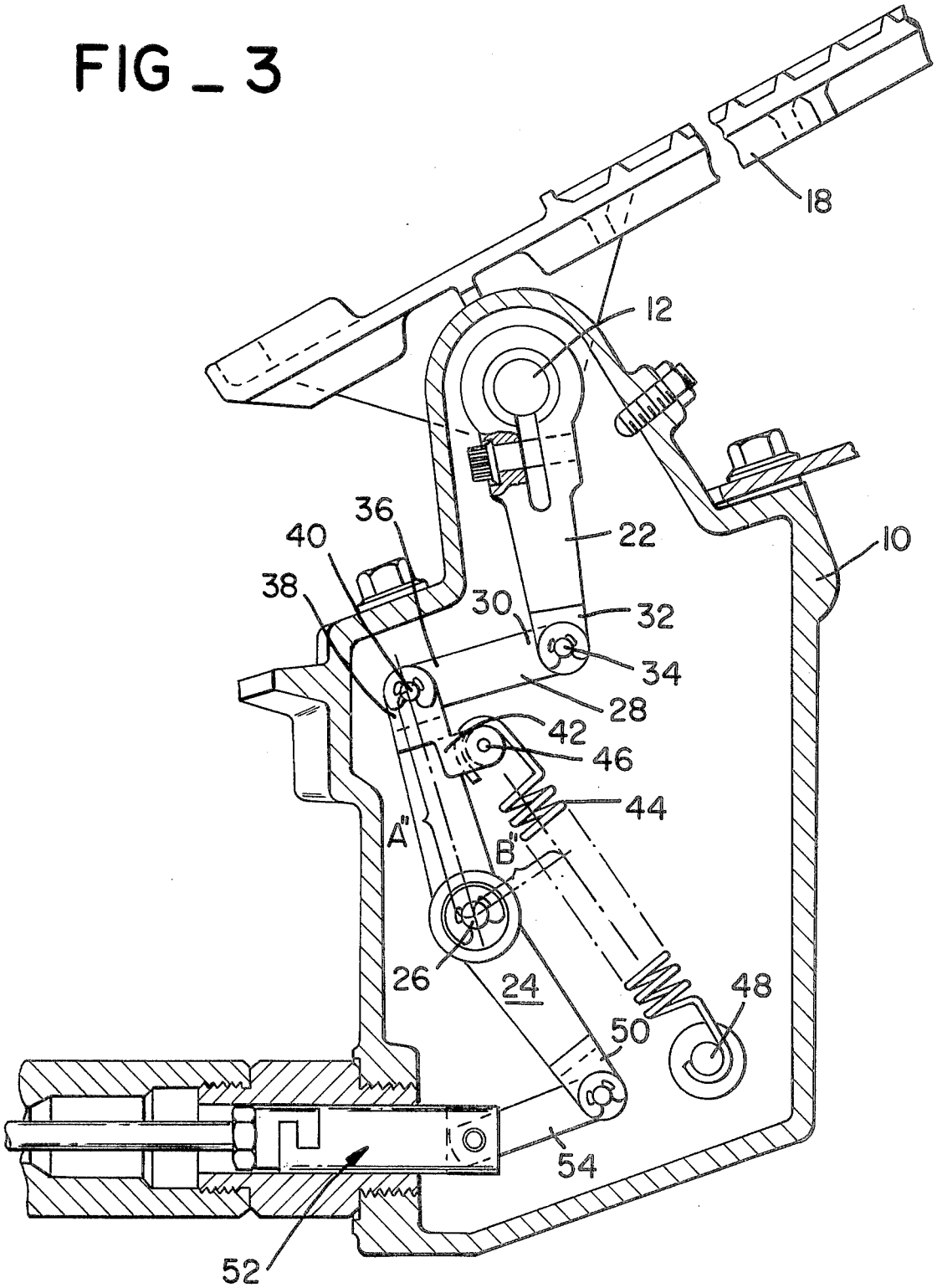
FIG. 3 is a view similar to that shown in FIGS. 1 and 2 but with the pedal shown in its fully-depressed state.

It is to be seen that the links 22, 28, 24 are positioned so that depressing force applied to the pedal 18 with the pedal 18 in its fully-undepressed state (see FIG. 1) is applied to the link 24 through the link 22 and link 28 about an effective lever arm as shown at A in such FIG. 1. Upon a degree of depression of the pedal 18, as shown in FIG. 2, it is to be noted that the effective lever arm about which force is applied to the link 24 to pivot such link in the first direction thereof has increased in size as shown at A'. And, in the area of full depression of the pedal 18, it is seen that the link 24 has further shifted its position to provide yet further increased effective lever arm A'' about the fixed pivot defined by pin 40, through which force is applied from the link 28 to pivot the link 24 in the first direction thereof. Thus, through the shifting of such links 22, 28, 24, a continuously increasing effective lever arm, through which force is applied from the link 28 to the link 24, is provided as the pedal 18 is depressed to move the link 24 in the direction thereof to actuate the push-pull cable 52.

Furthermore, with the pedal 18 in its non-depressed state as shown in FIG. 1, the spring 44 applies spring force to the link 24 about an effective lever arm indicated at B, to resist movement of the link 24 in one direction thereof. As the pedal 18 is depressed to an extent, as shown in FIG. 2, the spring 44, while being extended to apply a greater absolute force to the link 24, to resist movement of such link 24 in the one direction thereof, acts to apply spring force through a lever arm indicated at B' which is decreased in size relative to the lever arm B. And, with the pedal 18 in its substantially fully-depressed state, the effective lever arm B'' is even shorter than the effective lever arm B'. Thus, as the actual value of the spring force applied to the link 24 increases as the pedal 18 is depressed, such spring force acts through a continuously decreasing effective lever arm about the pivot defined by pin 26.

The particular spring constant of the spring 44, along with the dimensioning of the links 22, 28, 24 and associated structure, are chosen to provide that the pivoting of the links 22, 28, 24 through depression of the pedal 18 in the first direction thereof is resisted by a substantially constant force through the continuously increasing effective lever arm through which force is applied from the link 28 to pivot the link 24, and through the continuously decreasing effective lever arm through which force is applied from the spring 44 to the link 24. Through such achievement of a constant force being necessary to depress the pedal 18 substantially throughout its range, the problems discussed above are overcome, meanwhile with the overall apparatus being extremely simple and efficient in design and construction.

What is claimed is:

1. A linkage mechanism comprising:

support means;

a first link pivotally mounted on a first fixed pivot relative to the support means and pivotable in first and second directions;

a second link pivotally mounted on a second fixed pivot relative to the support means and pivotable in first and second directions;

a third link having (i) a first portion pivotally mounted to a portion of the first link spaced from said first fixed pivot, and (ii) a second portion mounted to a portion of the second link spaced from said second fixed pivot;

the first, second and third links being arranged to provide that pivoting of the first link in said first direction thereof pivots the second link in said first direction thereof through said third link;

resilient means for resiliently resisting pivoting of the first and second links in said respective first directions thereof;

the first, second and third links being positioned so that as the first link is pivoted through the full travel thereof in said first direction thereof to pivot the second link in said first direction thereof through the third link, the third link shifts in position to provide, through the full travel of the first link, a continuously increasing effective lever arm about the second fixed pivot through which force is applied from the third link to pivot the second link in said first direction thereof.

2. The mechanism of claim 1 wherein the resilient means comprise an elongated resilient member having one end mounted relative to the support means and having the other end mounted relative to one of the first and second links, the resilience of the resilient member resisting pivoting of the first and second links in said first respective directions thereof.

3. The mechanism of claim 2 wherein the resilient member, and link relative to which said resilient member is mounted, are positioned so that said link relative to which the resilient member is mounted moves when pivoting in said first direction thereof to provide, through the full travel of the first link, a continuously decreasing effective lever arm about the fixed pivot associated with said link relative to which the resilient member is mounted, through which lever arm force is applied from the resilient member to the link relative to which said resilient member is mounted, to resist pivoting of said link relative to which said resilient member is mounted in said first direction thereof.

4. The mechanism of claim 3 wherein pivoting of the first and second links in said respective first directions thereof is resisted by a substantially constant resilient member force through the continuously increasing effective lever arm through which force is applied from the third link to pivot the second link in said one direction, and through the continuously decreasing effective lever arm through which force is applied from the resilient member to the link relative to which the resilient member is mounted.

5. The mechanism of claim 4 wherein the resilient member comprises a helical spring one end of which is mounted relative to the support means and the other end of which is mounted relative to the second link.

6. The apparatus of claim 5 and further comprising pedal means fixed relative to the first link to pivot therewith about said first fixed pivot.

7. The mechanism of claim 6 and further comprising cable means pivotally mounted to the second link, and which may be actuated through pivoting of the pedal means about said first fixed pivot.

8. A linkage mechanism comprising:

support means;

a first link pivotally mounted on a first fixed pivot relative to the support means and pivotable in first and second directions;

a second link pivotally mounted on a second fixed pivot relative to the support means and pivotable in first and second directions;

a third link having (i) a first portion pivotally mounted to a portion of the first link spaced from said first fixed pivot, and (ii) a second portion mounted to a portion of the second link spaced from said second fixed pivot;

the first, second and third links being arranged to provide that pivoting of the first link in said first direction thereof pivots the second link in said first direction thereof through said third link;

resilient means for resiliently resisting pivoting of the first and second links in said respective first directions thereof;

the resilient means comprising an elongated resilient member having one end mounted relative to the support means and having the other end mounted relative to one of the first and second links, the resilience of the resilient member resisting pivoting of the first and second links in said first respective directions thereof;

wherein the resilient member, and link relative to which said resilient member is mounted, are positioned so that said link relative to which the resilient member is mounted moves when pivoting in said first direction thereof to provide, through the full travel of the first link, a continuously decreasing effective lever arm about the fixed pivot associated with said link relative to which the resilient member is mounted, through which lever arm force is applied from the resilient member to the link relative to which said resilient member is mounted, to resist pivoting of said link relative to which said resilient member is mounted in said first direction thereof.

9. The mechanism of claim 8 wherein the resilient member comprises a helical spring one end of which is mounted relative to the support means and the other end of which is mounted relative to the second link.

10. The apparatus of claim 9 and further comprising pedal means fixed relative to the first link to pivot therewith about said first fixed pivot.

11. The mechanism of claim 10 and further comprising cable means pivotally mounted to the second link, and which may be actuated through pivoting of the pedal means about said first fixed pivot.

* * * * *